United States Patent [19]

Vataru et al.

[11] 4,160,461

[45] Jul. 10, 1979

[54] WATER AND ENERGY CONSERVATION SYSTEM

[76] Inventors: Marcel Vataru, 523 Kings Rd., Los Angeles, Calif. 90048; Leo Miller, 1062 Maybrook Dr., Beverly Hills, Calif. 90210; Dennis W. Schwesinger, 22708 Roda St., Canoga Park, Calif. 91304

[21] Appl. No.: 879,475

[22] Filed: Feb. 21, 1978

[51] Int. Cl.[2] ..... E03C 1/02

[52] U.S. Cl. ..... 137/337; 137/593; 137/613

[58] Field of Search ..... 137/334, 337, 593, 613

[56] References Cited

U.S. PATENT DOCUMENTS

| | | | |
|---|---|---|---|
| 2,829,669 | 4/1958 | Luzynski | 137/334 X |
| 2,842,155 | 7/1958 | Peters | 137/564 X |
| 3,754,563 | 8/1973 | Boals | 137/334 X |
| 3,799,181 | 3/1974 | Maddren | 137/337 X |
| 3,885,584 | 5/1975 | Hock | 137/334 X |

*Primary Examiner*—Gerald A. Michalsky
*Attorney, Agent, or Firm*—Philip M. Hinderstein

[57] ABSTRACT

A water and energy conservation system connectable between a hot water line and a hot water faucet comprising a reservoir for saving clean water normally wasted as the hot water tap is turned on and the cold water retained in the hot water line between the hot water system and the faucet is drained. When the hot water faucet is turned on, the water in the hot water line is conducted into the reservoir where it accumulates until the water in the reservoir reaches a predetermined temperature. At this time, the reservoir is drained through the hot water faucet.

15 Claims, 2 Drawing Figures

WATER AND ENERGY CONSERVATION SYSTEM

BACKGROUND OF THE INVENTION

1. Field of the Invention

The present invention relates to a water and energy conservation system and, more particularly, to a thermostatically controlled reservoir for saving clean water normally wasted as a hot water faucet is turned on and the cold water retained in the lines between the water heating system and the faucet is drained.

2. Description of the Prior Art

In a conventional plumbing system including a water heating system and hot and cold water faucets, it is a well known fact that water is retained in the hot water line between the water heating system and the hot water faucet and that with time, this water cools down. As a result, when one wants hot water, the usual procedure is to turn on the hot water faucet and to wait while the water retained in the hot water line between the water heating system and the faucet is drained. At this time, the water suddenly becomes hot, sometimes too hot, resulting in a burn hazard. In any event, the water which drains from the faucet until the water becomes hot is wasted.

In the past, this source of wasted water received little attention because water seemed to be a limitless commodity. In fact, the existing systems designed to solve the problem were concerned more with the inconvenience of waiting for the water to become hot than the waste of water. Specifically, it has been known to use a closed circuit water circulation system activated by means of a continuously operating, electrically driven water pump which circulates the water from the water heating system through the pipe lines and back to the hot water system. With such a closed circuit system, one has instant hot water. Another alternative has been to provide a small coil heater and to incorporate this into the hot water plumbing immediately proceeding the hot water tap. This had the effect of heating the water until it became hot by itself.

Today, we have become very much aware of the fact that water is not an unlimited commodity. Neither is energy. Therefore, the conventional plumbing system which wastes the cold water is no longer acceptable. Furthermore, while both systems described above which provide instant hot water do indeed save water, they do it at the expense of a significant amount of energy. Additionally, both of these systems are expensive to install, operate, and maintain.

SUMMARY OF THE INVENTION

According to the present invention, there is provided a water and energy conservation system which solves these problems in a manner unknown heretofore. With the present system, one will save the water normally wasted as a hot water tap is turned on and the cold water retained in the hot water line between the hot water system and the faucet is drained. On the other hand, the saving is not achieved at the expense of the consumption of a significant amount of energy. In fact, the present invention requires no power consumption, but rather operates on hydraulic principles. It is self-contained and easily installed by attaching it to the hot water plumbing outlet and to the hot water faucet.

In operation, no water will be allowed to flow from the hot water faucet until such time as the water has reached a predetermined temperature, at which time water will flow from the faucet. In this way, there is neither a waste of water nor energy. Such a system also eliminates the hot water faucet burn hazard, especially to young children.

Briefly, the present water and energy conservation system is connectable between a hot water line and a hot water faucet and comprises a reservoir having an inlet and an outlet, first control means connectable to the hot water line, the faucet, and the reservoir inlet for permitting the flow of water from the line into the reservoir when the faucet is open and for preventing the flow of water from the hot water line into the reservoir when the faucet is closed, and a second control means connectable between the reservoir outlet and the faucet for permitting the flow of water from the reservoir to the faucet when the water in the reservoir reaches a predetermined temperature.

It is therefore an object of the present invention to provide a water and energy conservation system.

It is a further object of the present invention to provide a system incorporating a thermostatically controlled reservoir for saving clean water normally wasted as a hot water faucet is turned on and the cold water retained in the lines between the hot water heating system and the faucet is drained.

It is a still further object of the present invention to provide a water and energy conservation system which requires no power consumption.

It is another object of the present invention to provide a water and energy conservation system which operates on hydraulic principles.

It is still another object of the present invention to provide a water and energy conservation system which is self-contained and easily installed between a hot water line and a hot water faucet.

Another object of the present invention is the provision of a water and energy conservation system which prevents the flow of water to a hot water faucet until the water reaches a predetermined temperature.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like or corresponding parts in the several figures and wherein:

DESCRIPTION OF THE PREFERRED EMBODIMENT

Figure 1:
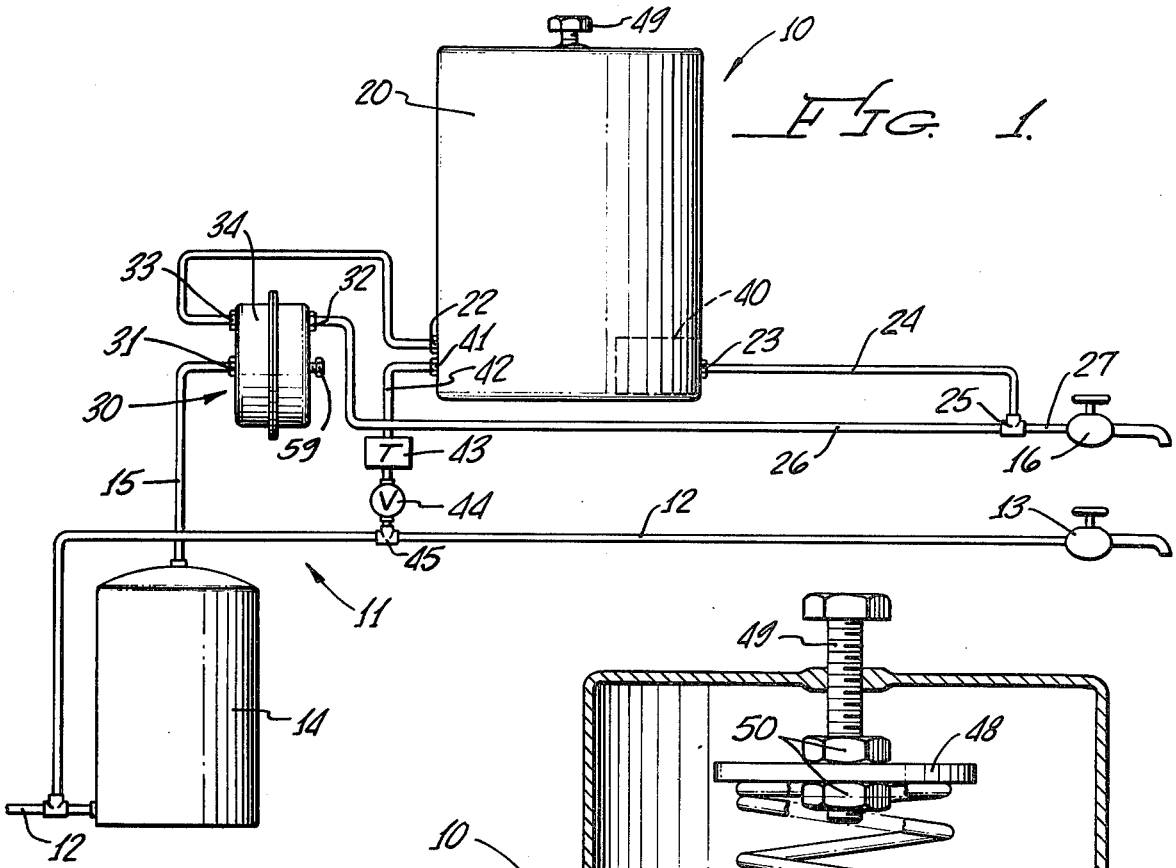
FIG. 1 is a schematic view of a conventional plumbing system with the present water conservation system installed therein.

Referring now to the drawings, the present water and energy conservation system, generally designated 10, is adapted to be installed in a conventional plumbing system 11. Plumbing system 11 has a cold water line 12 which is connectable directly to a cold water faucet 13 and to the input of a hot water heater 14. The output of heater 14 is connected to a hot water line 15 which is normally connected to a hot water faucet 16. As can be seen in FIG. 1, water and energy conservation 10 is connectable between hot water line 15 and faucet 16.

System 10 includes a tank 20 defining a reservoir 21. Reservoir 21 has an inlet 22 and an outlet 23. Outlet 23 is connected via a water line 24 to a "tee" 25 which is also connected to water lines 26 and 27. Water line 27 is connected to hot water faucet 16.

System 10 further comprises a first control means, specifically a differential pressure switch, generally designated 30, having an inlet 31 connectable to hot water line 15, an inlet 32 connectable to line 26, and an outlet 33 connectable to inlet 22 of reservoir 21. Switch 30 functions to permit the flow of water from line 15 into inlet 22 of reservoir 21 when faucet 16 is open and to prevent the flow of water from line 15 into reservoir 21 when faucet 16 is closed.

Specifically, switch 30 preferably includes a housing 34 defining a chamber 35 and having a flexible diaphragm 36 extending entirely across chamber 35. Inlet 31 and outlet 33 are positioned on one side of diaphragm 36 whereas inlet 32 is positioned on the other side of diaphragm 36. Inlet 31 terminates in a pipe section 37 which is closely adjacent the one side of diaphragm 36. In addition, diaphragm 36 supports or has made integral therewith a sealing plug 38 which is coaxial with pipe section 37. A spring 39 positioned between the other side of diaphragm 36 and housing 34 normally biases diaphragm 36 so that sealing plug 38 is pushed into the open end of pipe section 37, normally preventing fluid communication between inlet 31 and chamber 35.

Figure 2:
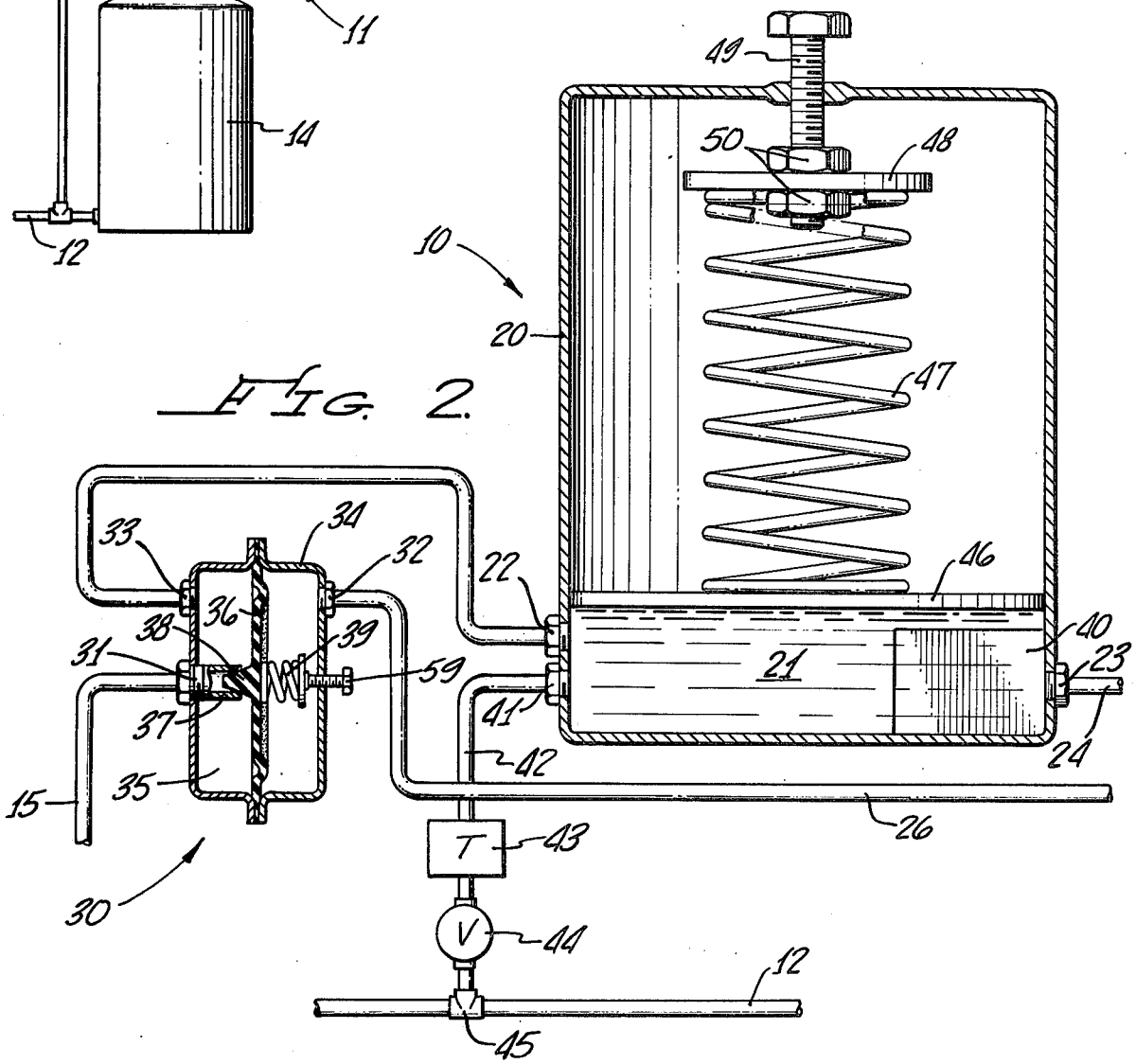
FIG. 2 is an enlarged sectional view of the reservoir and the differential pressure switch of the water conservation system of FIG. 1.

It will be evident from an inspection of FIGS. 1 and 2 that with faucet 16 closed, the pressure within lines 15 and 26 is the same and spring 39 maintains plug 38 in pipe section 37, preventing the flow of water from hot water line 15 into chamber 35 and from outlet 33 to inlet 22 of reservoir 21. On the other hand, when faucet 16 is opened, inlet 32 of switch 30 is connected to atmospheric pressure via line 26 and faucet 16. This subjects one side of diaphragm 36 to atmospheric pressure. The other side of diaphragm 36 is subjected to the pressure of hot water line 15, which is substantially greater, and sufficient to compress spring 39 and move sealing plug 38 out of pipe section 37. Thus, when faucet 16 is open, hot water from hot water heater 14 flows via line 15 into inlet 31 of switch 30 and from outlet 33 thereof to inlet 22 of reservoir 21.

System 10 further comprises a second control means, specifically a thermostatic valve 40, positioned in reservoir 21 and responsive to the temperature of the water therein. Valve 40 controls the flow of water into outlet 23 of reservoir 21 where it would flow to hot water faucet 16. Valve 40 is set to open at a predetermined temperature, such as 120° F. Thus, water will accumulate in reservoir 21 until the predetermined temperature is reached, at which time valve 40 will permit the flow of hot water to faucet 16.

System 10 further comprises means for draining reservoir 21 to eliminate any accumulated cold water therein. Specifically, reservoir 21 has a second outlet 41 which is connected via a water line 42, a thermostatic valve 43, a one-way valve 44, and a "tee" 45 to cold water line 12. Valve 43 may be identical to valve 40, but set to open at a lower temperature, such as 70° F. Valves 43 and 44 control the flow of cold water from reservoir 21 into line 12 while preventing the reverse flow of water from line 12 into reservoir 21.

Specifically, when the water in reservoir 21 is cold (i.e. lower than 70° F.), valve 43 is open and valve 44 permits the flow of water from reservoir 21 into cold water line 12 if faucet 13 is opened. This permits the draining of reservoir 21. On the other hand, one-way valve 44 prevents a reverse flow of cold water into reservoir 21 and valve 43 prevents the flow of hot water from reservoir 21 into line 12.

Reservoir 21 is preferably pressurized by means of a horizontally extending piston 46 mounted for vertical movement in tank 20. A spring 47 extends between piston 46 and a support plate 48 which is connected to one end of a bolt 49, such as by means of a pair of nuts 50. The body of bolt 49 is threaded in the top of tank 20 and the head of bolt 49 extends above tank 20. Rotation of bolt 49 causes rotation and vertical movement of plate 48 and an adjustment of the pressure of spring 47 on piston 46. Spring 39 in switch 30 may have a similar adjustment bolt 59 to adjust the pressure of plug 38 in pipe section 37.

In operation, switch 30 constitutes an on/off switch which permits the flow of water from hot water line 15 into reservoir 21 when faucet 16 is open and prevents the flow of water from hot water line 15 into reservoir 21 when faucet 16 is closed. When the temperature of the water in reservoir 21 is cold, thermostatic valve 43 and one-way valve 44 connect outlet 41 of reservoir 21 to cold water line 12. As a result, when cold water faucet 13 is turned on, any cold water in reservoir 21 will be drained. On the other hand, assuming cold water faucet 13 is closed and hot water faucet 16 is turned on, the differential pressure exerted on the opposite sides of diaphragm 36 will cause water to flow from hot water heater 14 and line 15 into reservoir 21. Since outlet 23 of reservoir 21 is now closed by thermostatic valve 40 and since faucet 13 is also closed, water is precluded from flowing out of reservoir 21.

The cold water normally retained in hot water line 15 will now flow into reservoir 21 and water will start to accumulate in reservoir 21. As reservoir 21 fills, piston 46 will be driven upwardly, compressing spring 47. All during this time, no water is flowing from faucet 16.

At such time as the water in reservoir 21 reaches the predetermined temperature determined by thermostatic valve 40, valve 40 opens, connecting outlet 23 of reservoir 21 to faucet 16. This permits the hot water to flow out of faucet 16. As the pressure between inlet 22 and outlet 23 equalizes, the water from hot water heater 14 is impeded because of the increased pressure on the water in reservoir 21 caused by spring 47 and piston 46. As a result, spring 47 starts to expand, moving piston 46 downwardly, emptying reservoir 21.

In the event that no hot water is available from heater 14, thermostatic valve 40 will not permit the flow of water from outlet 23 to faucet 16, causing reservoir 21 to fill to its maximum and terminating the flow of water thereinto. Under these circumstances, no water will flow from faucet 16 and no water will be wasted. On the other hand, when cold water faucet 13 is turned on, the cold water in reservoir 21 will be drained via valves 43 and 44 and line 12.

While the invention has been described with respect to a preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

We claim:

1. A water conservation system connectable between a hot water line and a hot water faucet comprising:

a reservoir having an inlet and an outlet;

first control means connectable to said hot water line, said faucet, and said reservoir inlet for permitting the flow of water from said line into said reservoir when said faucet is open and for preventing the flow of water from said line into said reservoir when said faucet is closed; and second control means connectable between said reservoir outlet and said faucet for permitting the flow of water from said reservoir to said faucet when said water in said reservoir is at or above a predetermined temperature and for preventing the flow of water from said reservoir to said faucet when said water in said reservoir is below said predetermined temperature.

2. A water conservation system according to claim 1, wherein said first control means comprises:

a differential pressure switch responsive to the pressure between said hot water line and said faucet.

3. A water conservation system according to claim 2, wherein said differential pressure switch comprises:

a housing defining a chamber having a diaphragm extending entirely thereacross, said housing having a first inlet and an outlet on one side of said diaphragm and a second inlet on the other side thereof, said first inlet being connected to said hot water line, said outlet being connected to said reservoir inlet, and said second inlet being connected to said faucet, said diaphragm supporting a sealing plug which is aligned with said first inlet; and means for biasing said sealing plug into contact with said first inlet for normally preventing fluid communication between said first inlet and said outlet, the pressure differential caused by opening of said faucet overcoming said biasing means and moving said sealing plug out of contact with said first inlet to permit water flow from said first inlet to said outlet and to said reservoir inlet.

4. A water conservation system according to claim 3, further comprising:

means for pressurizing said reservoir whereby the pressure therein increases as said reservoir is filled.

5. A water conservation system according to claim 4, wherein said pressurizing means comprises:

a piston extending horizontally across said reservoir and being movable vertically therein; and a spring connected between the top of said reservoir and said piston whereby as said reservoir is filled, said piston is moved upwardly, compressing said spring.

6. A water conservation system according to claim 5, wherein said second control means comprises:

a thermostatic valve positioned to sense the temperature of said water in said reservoir.

7. A water conservation system according to claim 6, wherein said valve is connected between said reservoir and said outlet thereof, said valve being operative to permit said flow of water from said reservoir to said faucet when said water in said reservoir reaches said predetermined temperature.

8. A water conservation system according to claim 3, wherein said second control means comprises:

a thermostatic valve positioned to sense the temperature of said water in said reservoir.

9. A water conservation system according to claim 8, wherein said valve is connected between said reservoir and said outlet thereof, said valve being operative to permit said flow of water from said reservoir to said faucet when said water in said reservoir reaches said predetermined temperature.

10. A water conservation system according to claim 1, further comprising:

means for pressurizing said reservoir whereby the pressure therein increases as said reservoir is filled.

11. A water conservation system according to claim 10, wherein said pressurizing means comprises:

a piston extending horizontally across said reservoir and being movable vertically therein; and a spring connected between the top of said reservoir and said piston whereby as said reservoir is filled, said piston is moved upwardly, compressing said spring.

12. A water conservation system according to claim 11, wherein said second control means comprises:

a thermostatic valve positioned to sense the temperature of said water in said reservoir.

13. A water conservation system according to claim 12, wherein said valve is connected between said reservoir and said outlet thereof, said valve being operative to permit said flow of water from said reservoir to said faucet when said water in said reservoir reaches said predetermined temperature.

14. A water conservation system according to claim 1, wherein said second control means comprises:

a thermostatic valve positioned to sense the temperature of said water in said reservoir.

15. A water conservation system according to claim 14, wherein said valve is connected between said reservoir and said outlet thereof, said valve being operative to permit said flow of water from said reservoir to said faucet when said water in said reservoir reaches said predetermined temperature.

* * * * *